US005697817A

United States Patent [19]

Bouchan et al.

[11] Patent Number: 5,697,817

[45] Date of Patent: Dec. 16, 1997

[54] MODULAR JACK TYPE CONNECTOR

[75] Inventors: Christophe Bouchan, Longjumeau; Franck Bordron, Paris, both of France

[73] Assignee: Molex Incorporated, Lisle, Ill.

[21] Appl. No.: 391,753

[22] Filed: Feb. 21, 1995

[30] Foreign Application Priority Data

Mar. 26, 1994 [EP] European Pat. Off. ..... 94104828

[51] Int. Cl.[6] ..... H01R 23/02

[52] U.S. Cl. ..... 439/676; 439/620; 439/941

[58] Field of Search ..... 439/620, 676, 439/941

[56] References Cited

U.S. PATENT DOCUMENTS

| | | | |
|---|---|---|---|
| 4,695,115 | 9/1987 | Talend | 439/76 |
| 4,772,224 | 9/1988 | Talend | 439/607 |
| 5,015,204 | 5/1991 | Sakamoto | 439/620 |
| 5,069,641 | 12/1991 | Sakamoto | 439/620 |
| 5,139,442 | 8/1992 | Sakamoto | 439/620 |
| 5,213,522 | 5/1993 | Kojima | 439/620 |
| 5,299,956 | 4/1994 | Brownell et al. | 439/941 |
| 5,310,363 | 5/1994 | Brownell et al. | 439/676 |
| 5,362,257 | 11/1994 | Neal et al. | 439/676 |

*Primary Examiner*—P. Austin Bradley
*Assistant Examiner*—Brian J. Biggi
*Attorney, Agent, or Firm*—A. A. Tirva

[57] ABSTRACT

A modular jack type connector includes a dielectric housing having a plug-receiving cavity open at one end of the housing. A plurality of terminals are mounted on the housing, with spring beam contact portions extending in cantilever fashion in a single row within the plug-receiving cavity. The contact portions extend from curved base portions located in the housing. Tail portions of the terminals project from the housing in two rows generally parallel to the single row of contact portions, such that each pair of adjacent terminals includes a tail portion in each row thereof. The terminals include straight intermediate sections extending between the curved base portions and the tail portions, with the intermediate sections of each pair of adjacent terminals being substantially separated from each other in a direction transversely of the rows. The terminals include transversely inwardly bowed sections joining the intermediate sections and the tail portions, with the inwardly bowed sections overlapping each other in a plane generally parallel to the rows.

4 Claims, 3 Drawing Sheets

MODULAR JACK TYPE CONNECTOR

FIELD OF THE INVENTION

This invention generally relates to the art of electrical connectors and, particularly, to a modular jack type connector having a terminal system to reduce crosstalk.

BACKGROUND OF THE INVENTION

Generally, a modular jack type connector includes "spring beam contacts" which protrude from a portion of the jack housing into a plug-receiving cavity of the housing, the contacts or terminals usually being separated from each other by molded portions of the housing. The terminals include terminal portions, usually in the form of pins for mating with the terminals of a complementary electrical device. For instance, the terminal pins may form solder tails for insertion into holes in a printed circuit board and for solder connection to circuit traces on the board and/or in the holes. In some instances, the terminal pins or solder tails are arranged in a single row, but in many other instances the terminal pins or solder tails are arranged in two rows of an alternatingly staggered array. The spring beam contacts protrude into the plug-receiving cavity normally in a single row.

As is well known in this art, such modular jack type connectors are quite small or miniaturized and, consequently, the terminals are very closely spaced. Consequently, there exists a never-ending problem of noise or crosstalk between adjacent terminals, particularly in elongated straight/parallel portions of the terminals. Various approaches have been made to eliminate or reduce the crosstalk, such as providing ground planes on the jacks, and coupling filter components, such as capacitor filters, between the terminals and the ground plane. Adding such additional components as ground planes to such miniaturized connectors adds significantly to the costs of the connectors.

The present invention is directed to solving these problems by providing a unique terminal configuration and/or array for reducing crosstalk between the terminals of the jack without adding components such as ground planes to the jack construction.

SUMMARY OF THE INVENTION

An object, therefore, of the invention is to provide a new and improved modular jack type connector of the character described above.

In the exemplary embodiment of the invention, the connector includes a dielectric housing means defining a plug-receiving cavity open at one end of the housing. A plurality of terminals are mounted on the housing with spring beam contact portions extending in cantilever fashion in a single row within the plug-receiving cavity. The contact portions extend from curved base portions fixed in the housing. The terminals include tail portions projecting from the housing in two rows generally parallel to the single row of contact portions, such that each pair of adjacent terminals includes a tail portion in each row thereof.

The invention contemplates that the terminals include intermediate sections extending between the curved base portions and the tail portions of the terminals, with the intermediate sections of each pair of adjacent terminals being substantially separated from each other in a direction transversely of the rows. The terminals include transversely inwardly bowed sections joining the intermediate sections and the tail portions of the terminals, with the inwardly bowed portions overlapping each other in a plane generally parallel to the rows.

It also is contemplated that the intermediate sections of the terminals have predetermined lengths which are based on no parallel portions of terminals greater than six millimeters for hundred megahertz of current through the terminals.

Another feature of the invention may include a capacitor filter component coupled between the curved base portions of at least one of the pairs of adjacent terminals.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
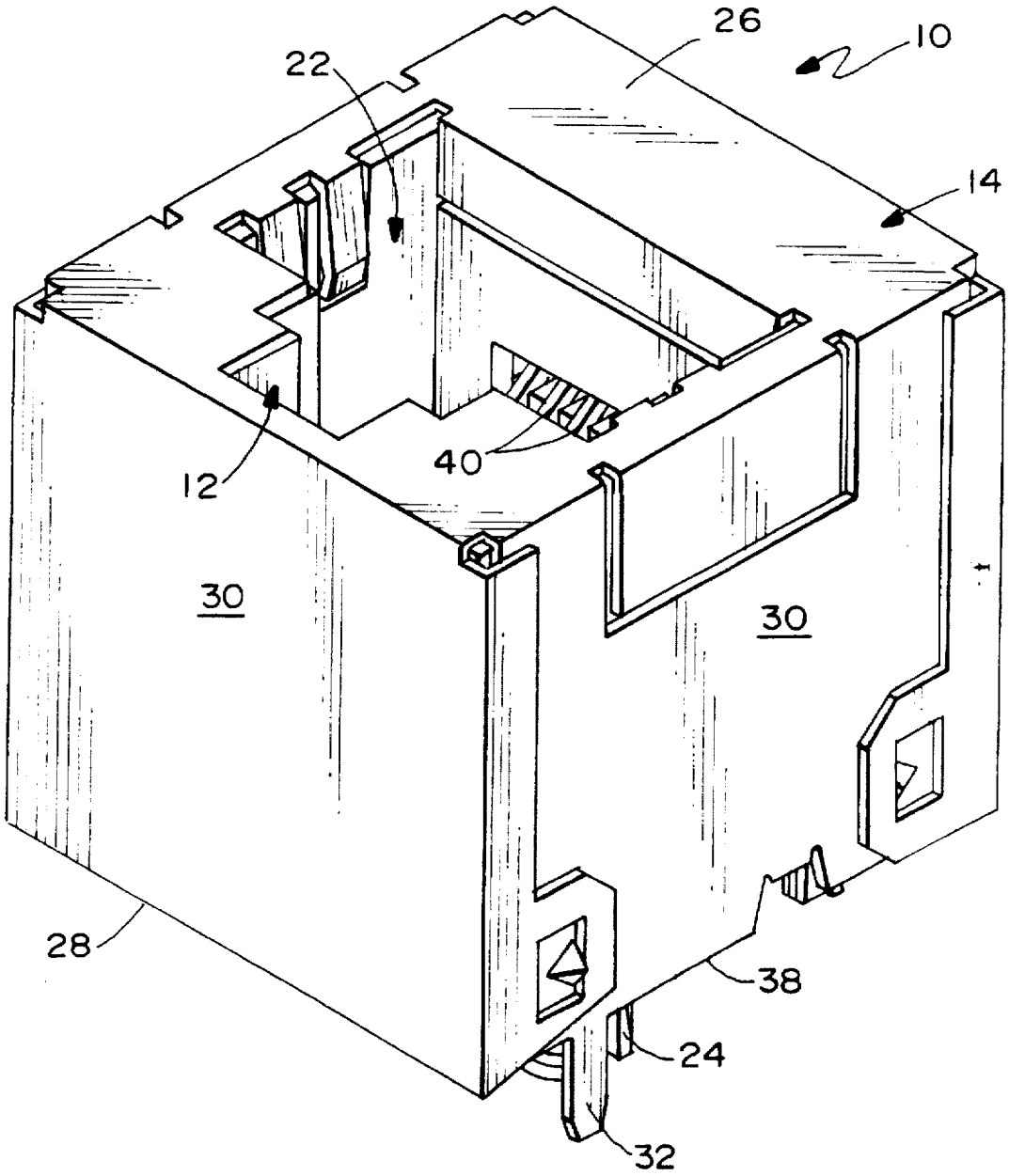
FIG. 1 is a perspective view of a modular jack type connector incorporating the concepts of the invention.
Figure 2:
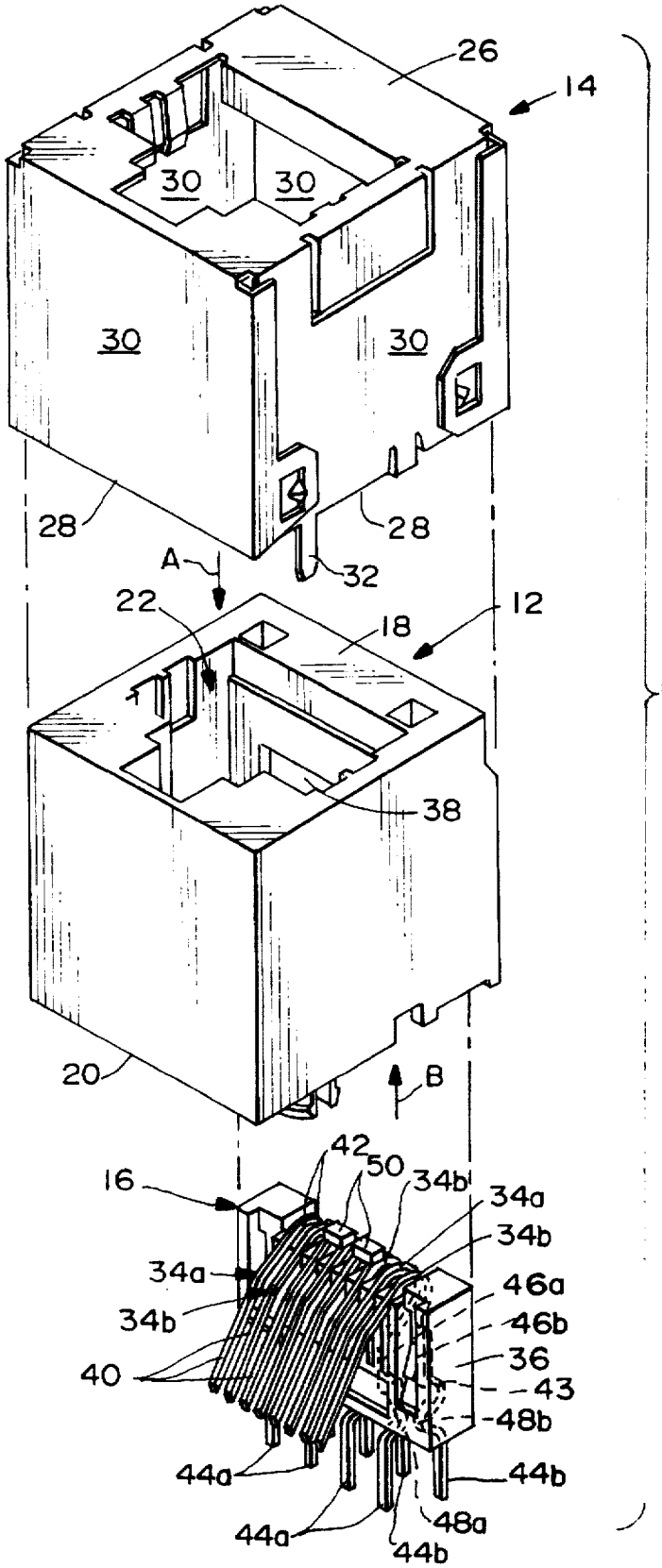
FIG. 2 is an exploded perspective view of the components of the connector.

Referring to the drawings in greater detail, and first to FIGS. 1 and 2, the invention is embodied in a modular jack type connector, generally designated 10 in FIG. 1. As seen in FIG. 2, in assembly, the connector includes three main components, namely: a dielectric housing means, generally designated 12; a shield, generally designated 14; and a terminal module, generally designated 16.

Housing 12 is unitarily molded of dielectric material such as plastic or the like in a generally cube-shaped configuration to define a mating face 18 and a mounting face 20. The housing defines a plug-receiving cavity, generally designated 22, extending inwardly from mating face 18 for receiving a complementary jack plug as is known in the art. The housing is adapted for mounting to a printed circuit board (not shown), and one or more integrally molded mounting posts 24 project from mounting face 20 for insertion into appropriate mounting holes in the board.

Shield 14 is stamped and formed of sheet metal material and, like housing 12, includes a mating face 26 and a mounting face 28. Actually, the mounting face is formed by the edges of four side walls 30 of the shield. The shield is generally box-shaped and is adapted to be mounted over housing 12, such as in the direction of arrow "A" (FIG. 2). One or more mounting feet 32 are stamped integrally with one or more of side walls 30 and project from edges 28 for insertion into appropriate holes in the printed circuit board. The feet are soldered to appropriate ground traces on the board and/or in the holes.

Terminal module 16 includes a plurality of terminals, generally designated 34*a* and 34*b*, which are insert molded into a dielectric terminal block 36. Terminal module 16 is assembled into housing 12 in the direction of arrow "B" (FIG. 2), the module being located in an interior cavity 38 of the housing.

Figure 3:
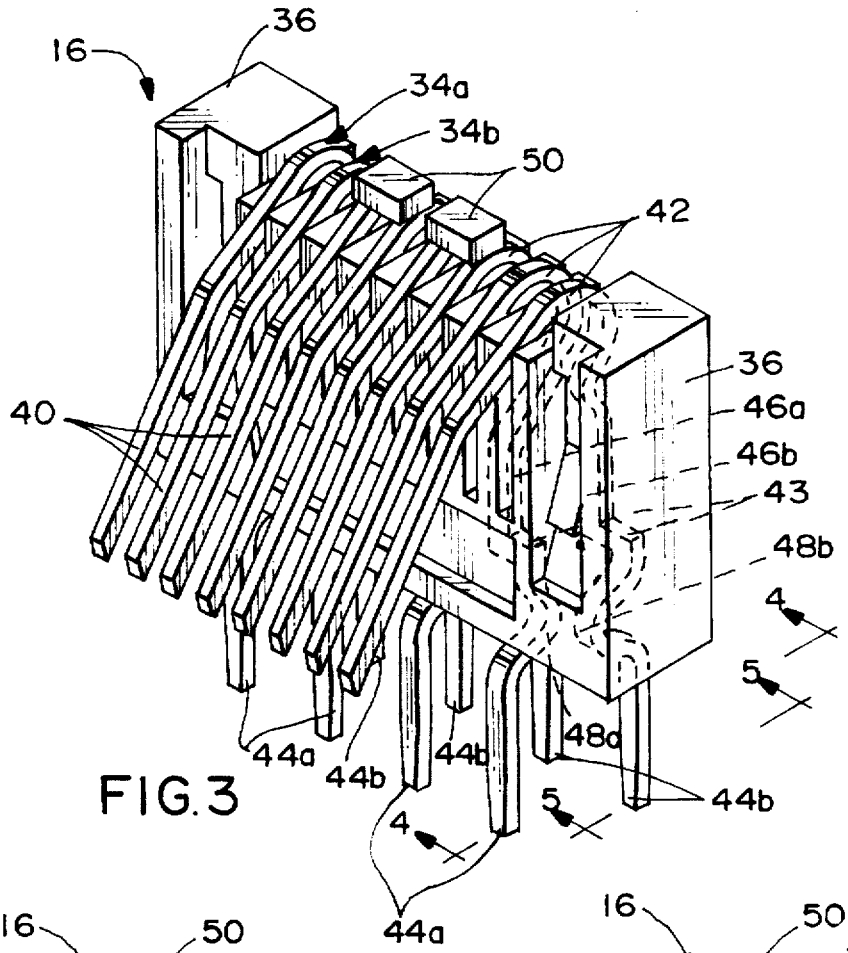
FIG. 3 is a perspective view of the terminal module of the connector.

Referring to FIG. 3 in conjunction with FIGS. 1 and 2, each of terminals 34*a* and 34*b* include a spring beam contact portion 40 which extends in cantilever fashion in a single row within plug-receiving cavity 22 of the housing. The spring beam contact portions extend from curved base portions 42 located within the housing outside the plug-receiving cavity. Offset portions 43 of the terminals are provided for loading purposes. Tail portions 44*a* and 44*b* for terminals 34*a* and 34*b*, respectively, project from terminal block 36 and mounting face 20 of housing 12 for insertion into holes in the printed circuit board for solder connection to circuit traces on the board and/or in the holes. Tail portions 44*a* and 44*b* are in two rows generally parallel to the single row of contact portions 40 such that tail portions 44*a* are in one row and tail portions 44*b* are in a second row. In other words, each pair of adjacent terminals 34*a* and 34*b* includes a tail portion in each row thereof.

Figure 4:
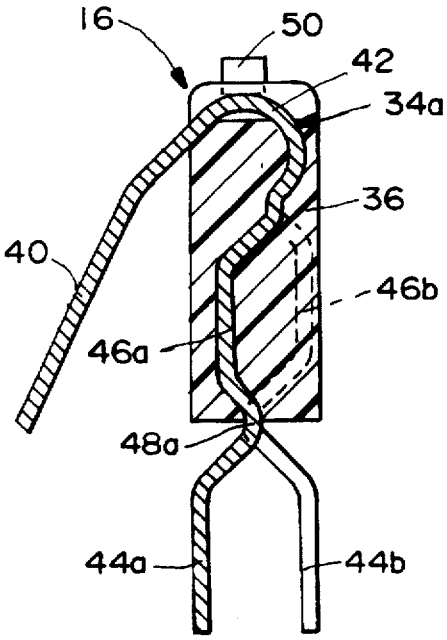
FIG. 4 is a section taken generally along line 4—4 of FIG. 3, showing one of the terminals in each pair of adjacent terminals.
Figure 5:
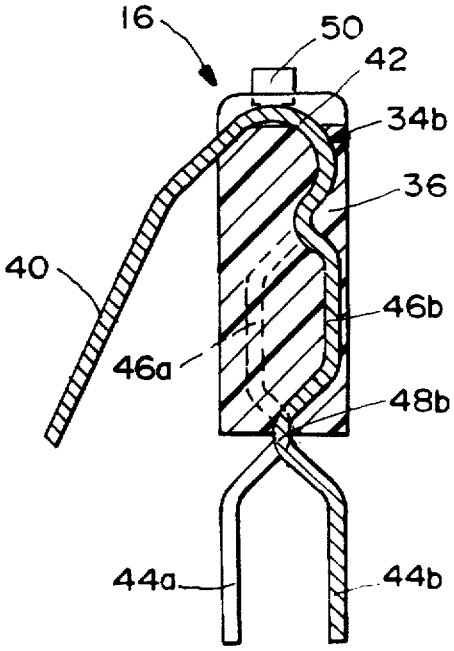
FIG. 5 is a section taken generally along line 5—5 of FIG. 3, showing the other terminal in each pair thereof.

Referring to FIGS. 4 and 5 in conjunction with FIG. 3, the invention contemplates that each terminal 34*a* and 34*b* includes an intermediate section 46*a* and 46*b*, respectively, which extend between curved base portions 42 and tail portions 44*a* and 44*b*, respectively. It can be seen best in FIGS. 4 and 5 that the intermediate sections are straight run generally parallel to each other within terminal block 36, but intermediate sections 46*a* of terminals 34*a* are substantially separated from intermediate sections 46*b* of terminals 34*b* in a direction transverse to the single row of contact portions 40 and the two rows of tail portions 44*a* and 44*b*. In other words, the intermediate sections of each pair of adjacent terminals are substantially separated from each other in a direction transversely of said rows.

The invention further contemplates that terminals 34*a* and 34*b* include transversely inwardly bowed sections 48*a* and 48*b*,respectively, joining intermediate sections 46*a* and 46*b*, respectively, and tail portions 44*a* and 44*b*, respectively. It can be seen clearly in FIGS. 4 and 5 that inwardly bowed sections 48*a* and 48*b* overlap each other in a plane generally parallel to the single row of contact portions 40 and the two rows of tail portions 44*a* and 44*b*.

Therefore, when imaging any pair of adjacent terminals 34*a* and 34*b*, the length of the terminals between curved base portions 42 and tail portions 44*a* and 44*b* include substantially separated portions at intermediate sections 46*a* and 46*b*, and overlapping portions at inwardly bowed sections 48*a* and 48*b*. It has been found that this configuration and/or array of terminal sections alternatingly along the entire row of terminals is very effective to reduce noise or crosstalk in the modular jack. By these configurations, significant lengths of parallel sections between adjacent terminals are avoided. To that end, the lengths of intermediate sections 46*a* and 46*b* preferably should be predetermined to achieve maximum reduction of crosstalk. For instance, in a standard dimensioned modular jack, intermediate sections 46*a* and 46*b* should have predetermined lengths based on no parallel portions of terminals greater than six millimeters for hundred megahertz of current through the terminals.

Lastly, a feature of the invention which may be added to the modular jack is the inclusion of a filter component coupled between adjacent terminals. More particularly, as seen in FIGS. 2 and 3, a capacitor filter component 50 is coupled between each of the two central pairs of terminals 34*a* and 34*b* wherein crosstalk may be the most prominent. It can be seen that the capacitor filter components are coupled between the curved base portions 42 of the pairs of terminals above terminal block 36 within housing cavity 38.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a modular jack type connector which includes a dielectric housing means defining a plug-receiving cavity open at one end of the housing means, a plurality of terminals mounted on the housing means with spring beam contact portions extending in cantilever fashion in a single row within the plug-receiving cavity, the contact portions extending from curved base portions located in a single row in the housing means, and including tail portions of the terminals projecting from the housing means in two rows generally parallel rows such that each pair of adjacent terminals includes a tail portion in each row thereof, wherein the improvement comprises said terminals including intermediate sections extending between the curved base portions and the tail portions of the terminals with the intermediate sections of each said pair of adjacent terminals being substantially separated from each other in a direction transversely of said rows of tail portions, and said terminals including transversely inwardly bowed sections joining the intermediate sections and the tail portions of the terminals with the inwardly bowed sections overlapping each other in a plane generally parallel to said rows and wherein said intermediate sections have predetermined lengths based on no parallel portions of terminals greater than six millimeters for hundred megahertz of current through the terminal.

2. In a modular jack type connector as set forth in claim 1, including a capacitor filter component coupled between the curved base portions of at least one of said pairs of adjacent terminals.

3. A modular jack type connector, comprising:

a dielectric housing means defining a plug-receiving cavity open at one end of the housing means; and a plurality of terminals mounted on the housing means with spring beam contact portions extending in cantilever fashion within the plug-receiving cavity, generally straight sections of the terminals extending within the housing means in two spaced rows toward an exterior face of the housing means such that each pair of adjacent terminals includes a straight section in each row thereof, and inwardly bowed sections of the terminals located near the exterior face of the housing means, the inwardly bowed sections overlapping each other in a plane generally parallel to said rows of straight sections and wherein said straight sections have predetermined lengths based on no parallel portions of terminals greater than six millimeters for hundred megahertz of current through the terminal.

4. The modular jack type connector of claim 3, including a capacitor filter component coupled between at least one of said pair of adjacent terminals.

* * * * *